US008737661B2

(12) United States Patent
Akino

(10) Patent No.: US 8,737,661 B2
(45) Date of Patent: May 27, 2014

(54) NARROW DIRECTIONAL CONDENSER MICROPHONE

(75) Inventor: Hiroshi Akino, Machida (JP)

(73) Assignee: Kabushiki Kaisha Audio-Technica, Machida-shi (JP)

( * ) Notice: Subject to any disclaimer, the term of this patent is extended or adjusted under 35 U.S.C. 154(b) by 277 days.

(21) Appl. No.: 13/067,346

(22) Filed: May 26, 2011

(65) Prior Publication Data

US 2012/0014542 A1 Jan. 19, 2012

(30) Foreign Application Priority Data

Jul. 14, 2010 (JP) ..... 2010-159728

(51) Int. Cl.

| | |
|---|---|
| ***H04R 9/08*** | (2006.01) |
| ***H04R 11/04*** | (2006.01) |
| ***H04R 17/02*** | (2006.01) |
| ***H04R 19/04*** | (2006.01) |
| ***H04R 21/02*** | (2006.01) |
| *H04R 1/02* | (2006.01) |
| *H04R 25/00* | (2006.01) |

(52) U.S. Cl.

USPC ..... 381/356; 381/91; 381/355; 381/174

(58) Field of Classification Search

USPC ..... 381/150, 369, 170–181, 91, 111, 113, 381/355–358

See application file for complete search history.

(56) References Cited

U.S. PATENT DOCUMENTS 3,588,382 A * 6/1971 Reedyk ..... 381/174
3,793,489 A * 2/1974 Sank ..... 381/92

* cited by examiner

*Primary Examiner* — Matthew Eason
(74) *Attorney, Agent, or Firm* — Manabu Kanesaka

(57) ABSTRACT

There is provided a narrow directional condenser microphone having an acoustic tube, in which a condenser microphone unit having a large effective diaphragm area is arranged on the rear end portion side of the acoustic tube to achieve high sensitivity without an increase in the diameter of the acoustic tube. In a narrow directional condenser microphone in which a unidirectional condenser microphone unit configured by arranging a diaphragm and a backplate opposedly via a spacer is arranged on the rear end side of an acoustic tube 10, the narrow directional condenser microphone is provided with a unit pair assembly 20 configured by opposedly combining two of the condenser microphone units 20R and 20L with the diaphragm side thereof being parallel to each other, and the unit pair assembly 20 is arranged on the rear end side of the acoustic tube 10 in such a manner that the condenser microphone units 20R and 20L are arranged symmetrically with respect to the tube axis X of the acoustic tube 10.

6 Claims, 3 Drawing Sheets

NARROW DIRECTIONAL CONDENSER MICROPHONE

CROSS-REFERENCE TO RELATED APPLICATION

The present application is based on, and claims priority from, Japanese Application Serial Number JP2010-159728, filed Jul. 14, 2010, the disclosure of which is hereby incorporated by reference herein in its entirety.

TECHNICAL FIELD

The present invention relates to a narrow directional condenser microphone having an acoustic tube. More particularly, it relates to a narrow directional condenser microphone configured so that high sensitivity can be achieved by increasing an effective diaphragm area.

BACKGROUND ART

A narrow directional condenser microphone having an acoustic tube is also called a line microphone or a gun microphone from its shape, and is configured so that in the cylindrical acoustic tube, a similarly cylindrical condenser microphone unit is housed.

For example, as described in Japanese Patent No. 256295, the narrow directional condenser microphone is configured so that a diaphragm included in the condenser microphone unit is arranged perpendicularly to the tube axis (the directional axis or the sound pickup axis) of the acoustic tube.

Especially when sounds are picked up from a distant sound source, the narrow directional condenser microphone of this type is required to generate little self noise because the sound waves delivered from the sound source are weak.

In order to meet this requirement, the effective diaphragm area of the diaphragm included in the condenser microphone unit has only to be increased. For the construction of the conventional example, however, the diameter of the condenser microphone unit is restricted by the inside diameter of the acoustic tube, and the increase in the effective diaphragm area of the diaphragm has its limits.

If the acoustic tube having a large inside diameter is used, accordingly a unit having a large diameter can be adopted. However, a large-diameter acoustic tube unfavorably not only impairs the appearance of microphone but also increases the weight thereof.

As one method for increasing the effective diaphragm area of the diaphragm, Japanese Patent No. 3325913 describes that the diaphragm is made to have a rectangular shape. In this specification, the condenser microphone unit having a rectangular diaphragm is sometimes referred to as a rectangular unit.

Besides, as the microphone using the rectangular unit, Japanese Patent No. 4383242 describes that a narrow directional microphone is provided by using three rectangular units. Also, Japanese Patent Application Publication No. 2002-78062 describes a double capsule microphone having two rectangular units.

Although various types of microphones using the rectangular unit have been proposed, attempts have not been made to make the microphone have a special shape matching the rectangular unit and to incorporate the rectangular unit in the cylindrical acoustic tube.

Accordingly, an object of the present invention is to provide a narrow directional condenser microphone having an acoustic tube, in which a condenser microphone unit having a large effective diaphragm area is arranged on the rear end portion side of the acoustic tube to achieve high sensitivity without an increase in the diameter of the acoustic tube.

SUMMARY OF THE INVENTION

To achieve the above object, the present invention provides a narrow directional condenser microphone in which a unidirectional condenser microphone unit configured by arranging a diaphragm and a backplate opposedly via a spacer is arranged on the rear end side of an acoustic tube, wherein the narrow directional condenser microphone is provided with a unit pair assembly configured by opposedly combining two of the condenser microphone units with the diaphragm side thereof being parallel to each other, and the unit pair assembly is arranged on the rear end side of the acoustic tube in such a manner that the condenser microphone units are arranged symmetrically with respect to the tube axis of the acoustic tube.

According to a preferred mode of the present invention, the diaphragm and backplate of each of the condenser microphone units included in the unit pair assembly are formed in a rectangular shape in which the side extending along the tube axis of the acoustic tube is a long side. That is, a rectangular unit is used as each of the condenser microphone units.

In the present invention, it is preferable that the outputs of the condenser microphone units included in the unit pair assembly, being connected in parallel, be connected to an impedance converter.

The present invention embraces a mode in which a plurality of unit pair assemblies are provided. In this case as well, it is preferable that a first output in which the outputs of the condenser microphone units on one side of the unit pair assemblies are connected in series and a second output in which the outputs of the condenser microphone units on the other side of the unit pair assemblies are connected in series, being connected in parallel, be connected to an impedance converter.

According to the present invention, the unit pair assembly is formed by opposedly combining two of the unidirectional condenser microphone units with the diaphragm side thereof being parallel to each other, and the unit pair assembly is arranged on the rear end side of the acoustic tube in such a manner that the condenser microphone units are arranged symmetrically with respect to the tube axis of the acoustic tube. Therefore, the condenser microphone unit (preferably, the rectangular unit) having a large effective diaphragm area can be used to achieve high sensitivity without an increase in the diameter of the acoustic tube.

Also, by connecting the outputs of the condenser microphone units included in the unit pair assembly, being connected in parallel, to the impedance converter, vibrating noise such as touch noise and handling noise can be reduced.

DETAILED DESCRIPTION

A narrow directional condenser microphone in accordance with an embodiment of the present invention will now be described with reference to FIGS. 1 to 7. The present invention is not limited to this embodiment.

Figure 1:
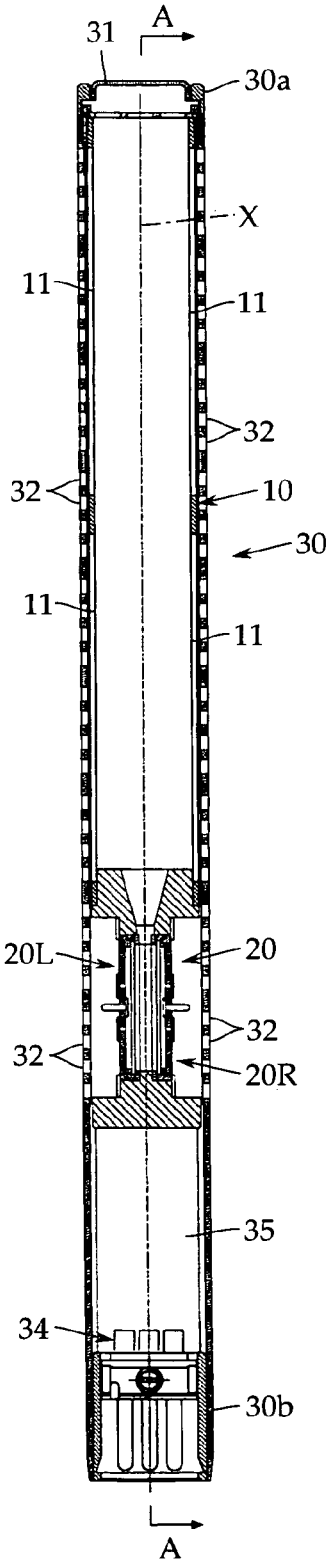
FIG. 1 is a sectional view, as viewed from the front, showing the internal construction of a narrow directional condenser microphone in accordance with an embodiment of the present invention.
Figure 2:
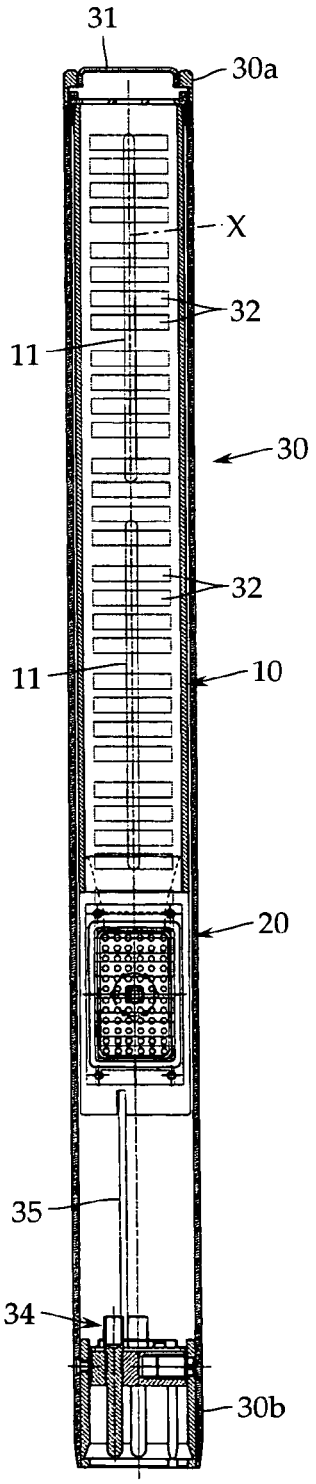
FIG. 2 is a sectional view taken along the line A-A of FIG. 1.

Referring to FIGS. 1 and 2, this narrow directional condenser microphone includes, as a basic configuration, an acoustic tube 10 formed in a cylindrical shape, a unit pair assembly 20, and a microphone casing 30.

The acoustic tube 10 may be formed of a metallic or synthetic resin material, and is provided with sound wave introduction holes 11 for interference in portions of the peripheral surface thereof. As in the ordinary mode, the sound wave introduction holes 11 may be formed along the tube axis X direction at positions 180° opposed to each other on the peripheral surface of the acoustic tube 10. The tube axis X is the center axis line of the acoustic tube 10, also being the sound pickup axis or the directional axis.

The unit pair assembly 20 includes two unidirectional condenser microphone units (hereinafter, sometimes referred simply to as "microphone units") as described later, and is arranged on the rear end side (the lower end side in FIGS. 1 and 2) of the acoustic tube 10.

The microphone casing 30 consists of a long cylindrical tube for covering the acoustic tube 10 and the unit pair assembly 20. On the front end (the upper end in FIGS. 1 and 2) 30*a* side of the microphone casing 30, which is directed to the sound source side at the time of sound pickup, a dust-proofing guard net 31 is provided.

The microphone casing 30 extends further to the rear beyond the unit pair assembly 20. In the microphone casing 30 on the rear end 30*b* side thereof, a three-pin type output connector 34 is mounted. Between the unit pair assembly 20 and the output connector 34 in the microphone casing 30, a circuit board 35 is arranged.

Although not shown in the figures, the circuit board 35 is mounted with an impedance converter, a sound signal output circuit, and the like. As the impedance converter, as in the ordinary mode, a field effect transistor (FET) is used.

On the peripheral surface of the microphone casing 30, openings 32 serving as sound wave transmitting holes are provided ranging from the front end 30*a* side to the portion in which the unit pair assembly 20 is housed. The openings 32, each consisting of a rectangular hole perpendicular to the axis line of the microphone casing 30, are arranged in rectangular slab shapes at predetermined intervals in the axis line direction of the microphone casing 30.

Figure 3:
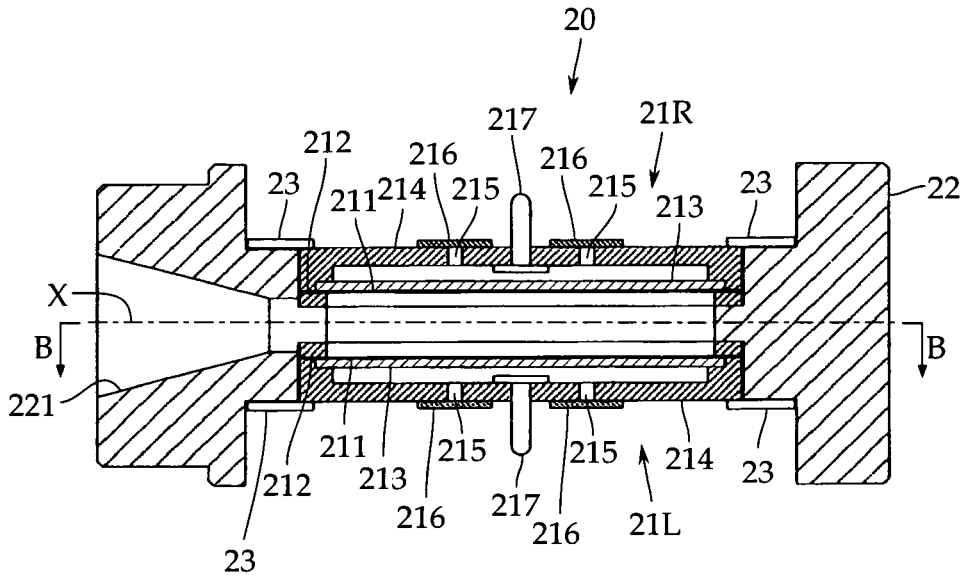
FIG. 3 is an enlarged sectional view showing a unit pair assembly shown in FIG. 1.
Figure 4:
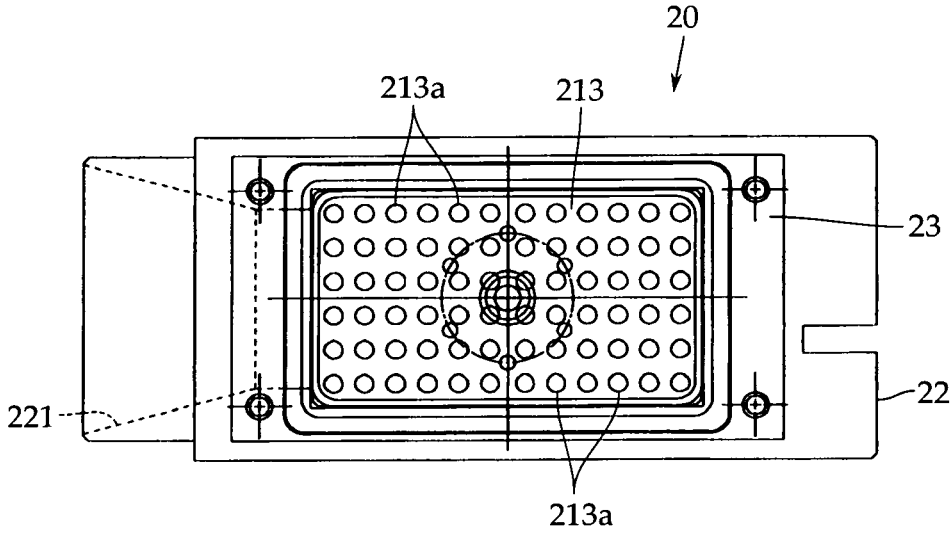
FIG. 4 is a sectional view taken along the line B-B of FIG. 3.
Figure 5:
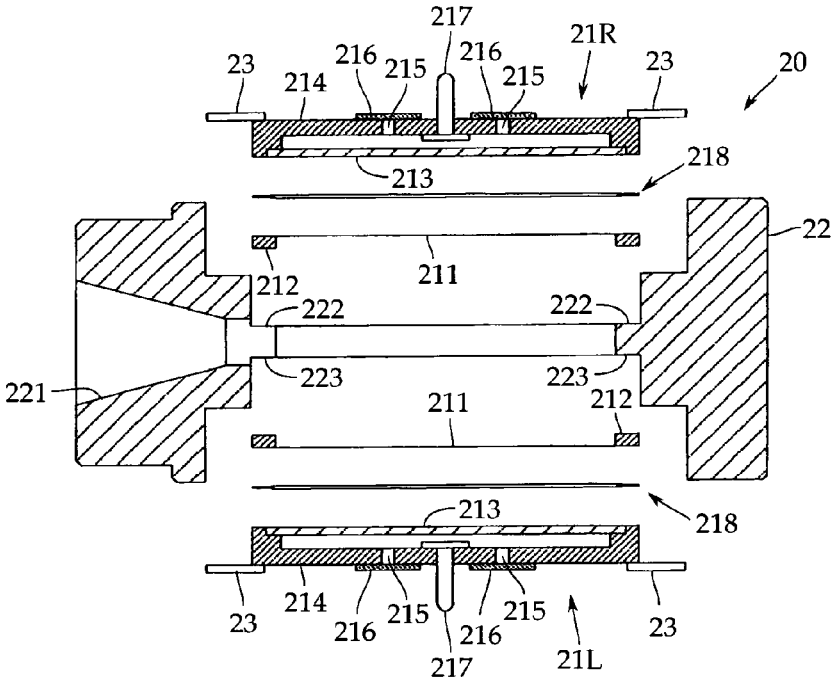
FIG. 5 is an exploded sectional view of FIG. 3.

Referring to FIGS. 3 to 5, the unit pair assembly 20 includes a pair of microphone units 21R and 21L. The microphone units 21R and 21L are unidirectional, and as the microphone units 21R and 21L, units that are almost the same including directivity frequency characteristics are used.

That is, each of the microphone units 21R and 21L is configured so that a diaphragm 211 stretchedly provided on a metallic support ring (diaphragm ring) 212 with a predetermined tension and a backplate 213 supported on a synthetic resin-made insulating seat 214 are arranged opposedly via a spacer ring 218.

As the diaphragm 211, a thin film of a synthetic resin having a metal deposit film on one surface opposite to the surface facing the backplate 213 may be used. Also, as the backplate 213, a metal plate such as an aluminum plate is used, and an electret film may be provided on the surface facing the diaphragm 211.

The insulating seat 214 is formed in a shallow dish shape so that an air chamber having a predetermined capacity is present on the back surface side of the backplate 213. At the peripheral edge of the insulating seat 214, the backplate 213 is fittedly fixed. In the bottom portion of the insulating seat 214, an electrode drawing-out terminal pin 217 electrically connected to the backplate 213 via a lead wire, not shown, is provided.

In this embodiment, both of the microphone units 21R and 21L are rectangular units. The diaphragm 211 is stretchedly provided on the support ring 212 consisting of a rectangular frame body, and the backplate 213 and the insulating seat 214 are formed in a rectangular shape.

Because the microphone unit is unidirectional, the diaphragm 211 side is a front acoustic terminal, and sound holes 215 serving as a rear acoustic terminal are formed in the bottom portion of the insulating seat 214. Each of the sound holes 215 is covered by an acoustic resistance material 216 consisting of a nonwoven fabric or a reticulated body.

As shown in FIG. 4, the backplate 213 is also formed with a large number of sound holes 213*a*, so that sound waves transmitted through the sound holes 215 (the rear acoustic terminal) in the insulating seat 214 pass through the sound holes 213*a* in the backplate 213 and act on the back surface of the diaphragm 211.

As shown in FIGS. 3 and 5, the microphone units 21R and 21L are assembled into a unit holder 22 in the state in which the diaphragm 211 sides thereof are opposed in parallel to each other, and are fixed to the unit holder 22 by pressing members 23 arranged on the circumference thereof.

The unit holder 22 is formed of a synthetic resin material, and the support rings 212 are brought into contact with the housing portion side of the microphone unit 21R and the housing portion side of the microphone unit 21L. On the surfaces opposed to the units 21R and 21L, level difference parts 222 and 223 for keeping the distance therebetween constant are formed.

On one end side on which the unit holder 22 is fitted at the rear end of the acoustic tube 10, a horn-shaped opening 221 is formed. The opening 221 is adapted to guide sound waves coming through the interior of the acoustic tube 10 to the front acoustic terminal between the opposed surfaces of the microphone units 21R and 21L.

Thus, the unit pair assembly 20 is mounted to the rear end portion side of the acoustic tube 10 in a state of including the pair of microphone units (rectangular units) 21R and 21L. In this case, as shown in FIGS. 1 and 2, the microphone units 21R and 21L are arranged symmetrically with respect to the tube axis X of the acoustic tube 10 in such a manner that the long side of rectangular unit extends along the tube axis X of the acoustic tube 10.

Thereby, the sound wave path leading to the front acoustic terminal side of the diaphragms 211 of the microphone units 21R and 21L and the sound wave path leading from the rear acoustic terminal side to the back surface of the diaphragm 211 are made approximately equal. Therefore, the microphone units 21R and 21L operate as unidirectional microphone units in which the directivity frequency responses are approximately equal.

Also, because each of the microphone units 21R and 21L is a rectangular unit, and moreover two rectangular units are present, the effective diaphragm area increases, which can make the sensitivity higher. In this respect, the rectangular unit of the present invention is compared with a conventional general circular unit in which the diaphragm and the backplate are circular.

For example, for a circular unit having an effective diaphragm diameter $\phi$ of 13 mm, the effective diaphragm area thereof is $6.5\times6.5\times3.14\approx132.7$ mm$^2$.

In contrast, in the case where two rectangular units each having a short side of 11.3 mm smaller than 13 mm and a long side of 20.5 mm are used, the effective diaphragm area is $(11.3\times20.5)\times2\approx463$ mm$^2$. As a result, an effective diaphragm area of about 3.5 times that of the circular unit can be obtained, and accordingly the sensitivity can be enhanced significantly.

Figure 6:
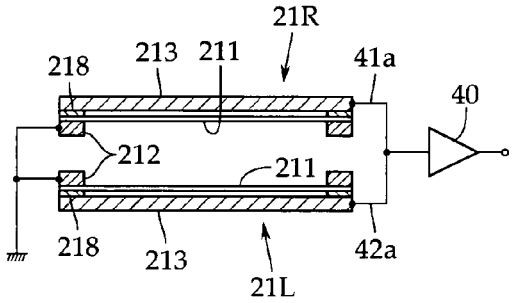
FIG. 6 is a schematic view showing: one example of connection wiring of a unit pair assembly.

As shown in FIG. 6, vibrations (what is called touch noise or handling noise) produced, for example, by the microphone casing 30 being rubbed by a hand are applied to the diaphragms 211 equally including the vibrating direction. Therefore, the diaphragms 211 are grounded (for example, connected to the microphone casing 30), and an input is applied to an impedance converter 40 with the output 41*a* of the microphone unit 21R and the output 42*a* of the microphone unit 21L being parallel, whereby vibrating noise can be canceled.

Figure 7:
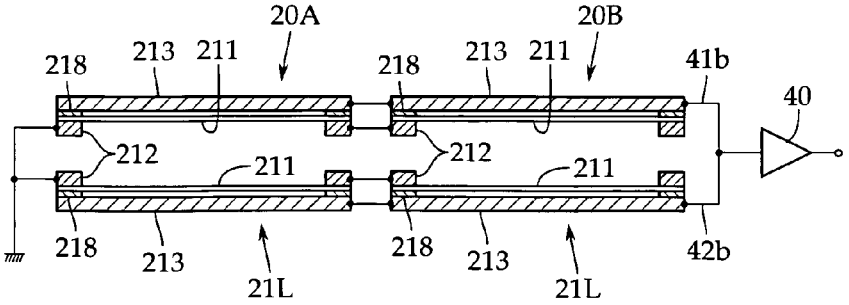
FIG. 7 is a schematic view showing another example of connection wiring of a unit pair assembly.

The present invention also embraces a mode in which a plurality of unit pair assemblies are provided. That is, as shown in FIG. 7, two unit pair assemblies 20A and 20B can be used.

In this case, the diaphragms 211 of the microphone units 21R on one side of the unit pair assemblies 20A and 20B are connected to each other in series, and the diaphragms 211 of the microphone units 21L on the other side of the unit pair assemblies 20A and 20B are connected to each other in series, and both diaphragms 211 are connected to the ground. The diaphragms 211 may be grounded individually.

Similarly, the backplates 213 of the microphone units 21R on one side of the unit pair assemblies 20A and 20B are connected to each other in series, and the backplates 213 of the microphone units 21L on the other side of the unit pair assemblies 20A and 20B are connected to each other in series, and an input is applied to the impedance converter 40 with the series outputs 41*b* and 42*b* being parallel.

In the above-described embodiment, the microphone units 21R and 21L included in the unit pair assembly 20 are rectangular units. However, the present invention also embraces a mode in which the unit pair assembly 20 is provided by using circular units as the microphone units 21R and 21L. In this case, the effective diaphragm area can be increased further by connecting the plurality of unit pair assemblies 20 as shown in FIG. 7.

The invention claimed is:

1. A narrow directional condenser microphone, comprising:

an acoustic tube, and at least one pair of unidirectional condenser microphone units arranged at a rear end side of the acoustic tube, each having a diaphragm, a backplate, and a spacer interposed therebetween, wherein the at least one pair of condenser microphone units is arranged such that the diaphragms directly face each other to be parallel to each other, and are disposed symmetrically with respect to a tube axis of the acoustic tube.

2. The narrow directional condenser microphone according to claim 1, wherein the diaphragm and backplate of each of the condenser microphone units are formed in a rectangular shape in which a side extending along the tube axis of the acoustic tube is a long side.

3. A narrow directional condenser microphone in which a unidirectional condenser microphone unit configured by arranging a diaphragm and a backplate opposedly via a spacer is arranged on a rear end side of an acoustic tube, wherein the narrow directional condenser microphone is provided with a unit pair assembly configured by opposedly combining two of the condenser microphone units with a diaphragm side thereof being parallel to each other, and the unit pair assembly is arranged on a rear end side of the acoustic tube in such a manner that the condenser microphone units are arranged symmetrically with respect to a tube axis of the acoustic tube, and wherein outputs of the condenser microphone units included in the unit pair assembly, being connected in parallel, are connected to an impedance converter.

4. A narrow directional condenser microphone, in which a unidirectional condenser microphone unit configured by arranging a diaphragm and a backplate opposedly via a spacer is arranged on a rear end side of an acoustic tube, wherein the narrow directional condenser microphone is provided with a unit pair assembly configured by opposedly combining two of the condenser microphone units with a diaphragm side thereof being parallel to each other, and the unit pair assembly is arranged on a rear end side of the acoustic tube in such a manner that the condenser microphone units are arranged symmetrically with respect to a tube axis of the acoustic tube, and wherein the narrow directional condenser microphone is provided with a plurality of unit pair assemblies, and a first output in which outputs of the condenser microphone units on one side of the unit pair assemblies are connected in series and a second output in which outputs of the condenser microphone units on the other side of the unit pair assemblies are connected in series, being connected in parallel, are connected to an impedance converter.

5. The narrow directional condenser microphone according to claim 1, further comprising a unit holder having housing portions opposing each other for housing the at least one pair of microphone units, and an opening on one side between the housing portions to guide sound waves coming through an interior of the acoustic tube.

6. The narrow directional condenser microphone according to claim 5, wherein the opening has a horn shape, and extends to a space between the housing portions for the at least one pair of microphone units.

* * * * *